United States Patent [19]

Takahashi

[11] Patent Number: 4,900,247

[45] Date of Patent: Feb. 13, 1990

[54] HIGH-TEMPERATURE HEATING FURNACE

[75] Inventor: Susumu Takahashi, Yokohama, Japan

[73] Assignee: Kanto Yakin Kogyo K.K., Japan

[21] Appl. No.: 343,575

[22] Filed: Apr. 27, 1989

[30] Foreign Application Priority Data

May 26, 1988 [JP] Japan ..... 63-69683[U]

[51] Int. Cl.[4] ..... F27B 9/08

[52] U.S. Cl. ..... 432/153; 432/59; 432/225

[58] Field of Search ..... 432/8, 59, 121, 122, 432/153, 184, 188, 224, 225, 230, 231; 219/388, 390

[56] References Cited

U.S. PATENT DOCUMENTS

| | | | |
|---|---|---|---|
| 1,766,545 | 6/1930 | Rendall | 432/153 |
| 4,160,641 | 7/1979 | Miskolczy et al. | 432/59 |
| 4,255,136 | 3/1981 | Suzuki et al. | 432/59 |
| 4,416,623 | 11/1983 | Takahashi | 432/153 |
| 4,553,929 | 11/1985 | Kanatani et al. | 432/59 |
| 4,580,972 | 4/1986 | Hsiung | 432/225 |
| 4,678,434 | 7/1987 | Dahl et al. | 432/225 |

*Primary Examiner*—Henry C. Yuen

*Attorney, Agent, or Firm*—Shlesinger, Fitzsimmons & Shlesinger

[57] ABSTRACT

In a high-temperature heating furnace, its central longitudinal passage in which articles to be heated are placed, and its inner support which makes a space between its inner surface and the above-mentioned passage for accommodating heaters therein and which makes also another space between its outer surface and a furnace shell for filling insulators therein, are both installed in the furnace by assembling a plurality of thin plates made of carbon fiber reinforced graphite or carbon compounds to cuboids which are coaxial to each other and have rectangular cross sections.

1 Claim, 1 Drawing Sheet

HIGH-TEMPERATURE HEATING FURNACE

BACKGROUND OF THE INVENTION

This invention relates to a heating furnace which is employed at a temperature higher than 1,800° C. for the carbonization of carbon fibers for example, and which is constructed by graphite or carbon structures.

Generally in a heating furnace of the kind mentioned above which is utilized at a temperature higher than 1,800° C., refractory structures made from alumina can not be used, as their melting points are too low to stand against such high temperature. Therefore, thermal insulation interior structures such as muffle cases, and heaters employed in such heating furnaces are made from graphite or carbon materials. And, it is conventional that such heating furnaces are consisted of a furnace core tube through which commodities to be heat-treated are passed, heaters located circumferentially outside of the tube, inner frames for keeping insulation materials at a desired configuration in order to make spaces necessary to radiate heat from heaters.

Graphite or carbon tubes are generally employed to make such inner frames, which tubes or plates being conventionally thick in order to have a necessary strength, and having usually a thickness of 10 to 30 mm. According, such inner frames become heavy. And, structural works for assembling the tubes into the inner frames become also heavy, whereby heat capacity of a heating furnace is disadvantageously wasted by those heavy tubes and heavy structural works.

It is also disadvantageous that since such graphite or carbon tubes, porosity of which is as much as 15–22%, readily absorb ambient gases and discharge the gases from themselves at an initial stage of operation when the furnace is heated, the furnace has to be operated idly for a comparatively long period of time.

BRIEF SUMMARY OF THE INVENTION

In view of the aforementioned drawbacks, this invention is to provide a novel high-temperature heating furnace, inner structures of which, particularly a core tube and an inner frame assembly which accommodates outwardly around the core tube a space for radiating heat from heaters and which supports simultaneously insulation materials between its outer surfaces and an inner shell of the furnace, are made from carbon fiber reinforced carbon or graphite compounds.

Said compounds which are graphite or carbon reinforced by carbon fibers carbonized under a high temperature, have a tensile strength as high as 10–30 $Kg/mm^2$, and therefore the compounds of only a 3–5 mm thickness can readily make up the core tube and inner frame assembly with a sufficiently high structural strength.

More in concrete, this invention provides a novel high-temperature heating furnace in which a central core passage which runs longitudinally along the central axis of the furnace, and an inner wall assembly which is located circumferentially outside of the core passage and makes a space between itself and the passage for accommodating heaters therein, are cuboid and consisted of a plurality of plates made of reinforced materials compounded by carbonized carbon fibers and graphite or carbon.

Hereinafter, the invention is explained by way of the following preferred example and with reference to the accompanying drawing.

EMBODIMENT

Figure 1:
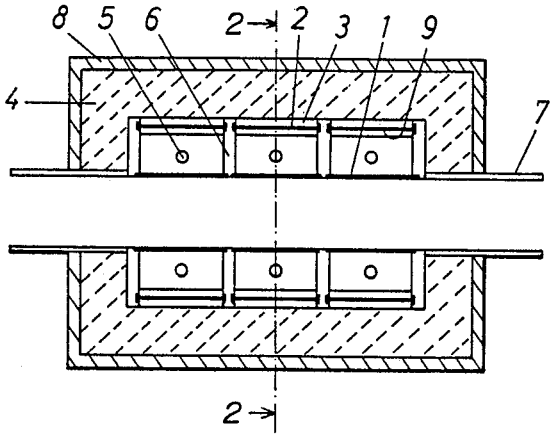
FIG. 1 is an explanatory side sectional view of the high-temperature heating furnace made in accordance with the present invention, along the line I—I of FIG. 2.
Figure 2:
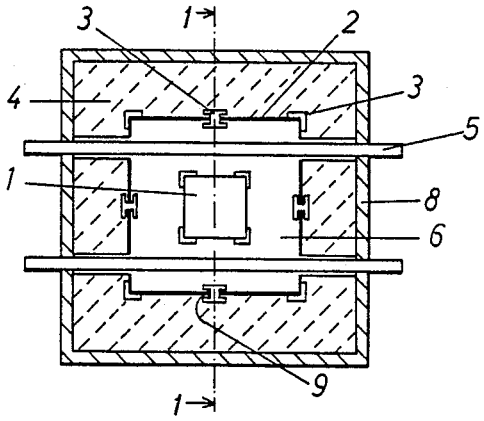
FIG. 2 is a front sectional view along the line II—II of FIG. 1.

A number of graphitized carbon fibers were placed flat so that they crossed to each other. There were impregrated with a carbonous binder and shaped to a flat layer, and then carbonized by heating it to 1,100° C. under pressure. Thereafter, it was processed at 2,000° C., whereby a square plate of 300 mm×300 mm with a thickness of 3 mm was obtained. This plate had a tensile strength of 500 $Kg/mm^2$, and its porosity was less than 5%.

By assembling a plurality of the plates thus obtained, a cuboid core passage 1 was made longitudinally along the central axis of a furnace. Likewise, a plurality of the plates were assembled to form a cuboid support 2 so that the support surrounds the central passage with a space therebetween which accommodates therein heaters 5. In assembling, grooves 9 which are provided to frames 3 and graphite partition plates 6 of a thickness of 20 mm, are utilized. The joints of the carbon fiber reinforced compound plates which have been assembled into the core passage 1 and the support 2, were hermeticed by carbonous adhesives.

Inlet and outlet cuboids 7 were fitted to a furnace outer shell 8, coaxially with the central passage 1, and blanket insulators 4 made of carbon fibers were filled up in the space between the support 2 and the shell 8. Graphite heaters 5 were placed in a space between the passage 1 and the support 2.

When the furnace explained above was operated, it was found that only 15–20% of all the heating volume was lost by its dissipation mainly from and through the passage 1 and the support 2, compared to the dissipation of 30–40% in conventional furnaces. This is primarily because that in conventional furnaces, the passage and support which are comparatively heavy, increase the dissipation of heat from the furnace.

And, it is also a advantageous point of the furnace made in accordance with this invention that since its central core passage 1 employs carbon fibers reinforced carbon paltes whcih are light in weight and have low porosity of about 5% or less, an atmosphere within the passage is brought to innert with a comparatively short period of heating operation. In fact, this shortening of the initial preparatory idle operation invited the reduction of about 10% of electricity required for said purpose.

Further in addition, it is advantageous in this invention that carbon fiber reinforced carbon compounds which are difficult to process or machine, are employed and utilized as they are produced, viz., as plates. This is great.

I claim:

1. A high-temperature heating furnace, which comprises;

a central enclosure passage for accommodating therein articles to be treated, extending along the longitudinal central axis of the furnace, and an enclosure support surrounding the central passage with a space therebetween, in which space heaters are accommodated, and outside of which and between which and an outer shell of the furnace insulators being filled;

said central passage and said support being cuboidal coaxially to each other and being consisted of a plurality of plates of a comparatively thin thickness made of carbon fiber reinforced carbon or graphite compounds which are assembled to have a rectangular cross section and joints of which are hermetized by carbon or graphite adhesives.

* * * * *